United States Patent [19]

Giovanelli

[11] 4,178,846

[45] Dec. 18, 1979

[54] APPARATUS FOR, AND A PROCESS OF, SECTOR ENGRAVING METAL ELEMENTS

[75] Inventor: Cesare Giovanelli, Gardone Val Trompia, Italy

[73] Assignee: Bottega Incisioni di Orizio-Giovanelli, Gardone Val Trompia, Italy

[21] Appl. No.: 811,868

[22] Filed: Jun. 30, 1977

[30] Foreign Application Priority Data

Apr. 21, 1977 [IT] Italy ..... 22724 A/77

[51] Int. Cl.[2] ..... B41F 17/00

[52] U.S. Cl. ..... 101/5; 101/22; 101/32; 72/74; 72/406; 72/703

[58] Field of Search ..... 101/5-8, 101/22, 32; 72/703, 74, 406

[56] References Cited

U.S. PATENT DOCUMENTS

| | | | |
|---|---|---|---|
| 434,539 | 8/1890 | Ecaubert | 101/6 X |
| 434,540 | 8/1890 | Ecaubert | 101/6 X |
| 435,834 | 9/1890 | Hofmann | 101/6 |
| 435,835 | 9/1890 | Hofmann | 101/6 X |
| 1,244,422 | 10/1917 | Carter | 72/74 |
| 1,461,853 | 7/1923 | Kennedy | 72/74 |

*Primary Examiner*—Clifford D. Crowder
*Attorney, Agent, or Firm*—Schwartz & Weinrieb

[57] ABSTRACT

Apparatus for, and a process of, sector engraving metal elements, is disclosed. The apparatus includes an engraving roller having a particular pattern formed thereon, and a workpiece mounting system which is capable of translational movement within two mutually orthogonal directions. When the engraving process is to be performed, the engraving roller is held in contact with the workpiece, and as a result of a first translational movement of the workpiece mounting system in a first direction, a predetermined sector of the engraving roller is caused to contact a predetermined portion of the workpiece whereby a predetermined portion of the roller pattern is reproduced upon the workpiece. Movement of the workpiece mounting system in the second direction causes another section of the engraving roller to be aligned with another portion of the workpiece whereupon repeated movement of the workpiece mounting system in the first direction serves to reproduce a new portion of the pattern upon the new portion of the workpiece.

15 Claims, 2 Drawing Figures

APPARATUS FOR, AND A PROCESS OF, SECTOR ENGRAVING METAL ELEMENTS

FIELD OF THE INVENTION

This invention relates generally to an apparatus for, and a process of, sector engraving metal elements, and more particularly to an apparatus for, and a process of, engraving decorative elements, or the like, upon arm parts.

BACKGROUND OF THE INVENTION

According to established customs or tradition it is common to engrave decorations of any design upon the metal sections of many arms, such as, for example, shotguns, pistols, revolvers, and the like.

Presently, the practice of making such decorative engravings is accomplished mechanically by copy pantographing, pressure rollers, or other similar equipment.

Particularly, such decorations are presently made by means of pressure roller machines, wherein the engraving matrices are made by means of a relief process upon cylindrical rollers which, when pressed upon or against the metal surfaces to be processed, will impress the decorative designs thereon.

However, while such operations may be accomplished quite rapidly, and accordingly such processes are advantageous from an economical viewpoint, the systems suffer from some substantial disadvantages deleteriously affecting the grade or quality of the finshed product and the cost thereof.

One of the disadvantages of the aforenoted systems is that in order to obtain such engravings, considerable pressure must be imposed upon the rollers in order to provide for deep penetration of the relieved matrices into and throughout the surface strip of the metal workpieces. In addition, this also requires the provision of machines having a somewhat rigid structure, and the use of skilled labor or additional servomechanisms to achieve the high pressures required.

Another disadvantage of the aforenoted systems is that while the high pressure developed between the rollers and the surfaces to be processed serves to provide deep engravings upon the workpieces, such pressures also tend to develop bulges or protuberances within the engraved metal parts. These irregular bulges or protuberances appear upon all of the engraved surfaces, and consequently, such quite obviously substantially impair the grade and value of the pieces being processed.

Still another disadvantage of the aforenoted systems is the fact that the same cannot be satisfactorily employed for processing workpieces having rounded pattern surfaces. When so employed, the engravings appear to be clearer and deeper at the central area of the workpieces and merely superficial within the vicinity of the rounded side edges of the workpieces due to a decrease in the pressure developed between the roller and the workpiece within the side edge regions of the workpiece as defined by the contact planes or surfaces of the roller and the workpiece.

OBJECTS OF THE INVENTION

Accordingly, it is an object of the present invention to provide apparatus for, and a process of, sector engraving metal elements, both planar and arcuate, which will overcome the aforenoted disadvantages of prior art devices and processes, and which will facilitate at the same time the production of engravings that are highly desirable and commercially acceptable from a qualitative viewpoint, and which are homogeneous or uniform with respect to engraving depth.

It is another object of the present invention to provide apparatus for, and a process of, sector engraving metal elements which will accomplish such engraving operations in an easy, rapid, and simple manner, and without the necessity of performing difficult mechanical operations.

It is another object of the invention to provide an engraving device which is quite simple in structure, and is, accordingly, economical to produce.

SUMMARY OF THE INVENTION

These and other objects are accomplished by means of a device, for sector engraving metal elements, comprising a pressure engraving roller, the peripheral surface of which, provided with relieved portions representing the design to be engraved, is of a domed arcuate shape. The roller is mounted within a fork which is capable of rocking about an axis perpendicular to the roller axis, and the roller fork assembly is disposed above a clamping device for the workpiece to be processed. The clamping device is provided with means for accomplishing a dual work movement, one movement mode of which is a to and fro reciprocating movement in a direction disposed perpendicular to the axis of the roller, while the other movement mode comprises a transverse translational motion with its direction disposed parallel to that of the roller. As an alternative to the reciprocating motion, the clamping device may be endowed with means for imparting thereto a rocking movement which is similar to, and the mirror-image of, the rocking movement of the supporting form for the engraving roller. When the aforenoted dual working movements of the clamping device are alternatively accomplished, the process of the present invention may consequently be performed in a step-wise manner in order to engrave an entire workpiece surface with the predetermined pattern provided upon the engraving roller.

BRIEF DESCRIPTION OF THE DRAWINGS

In order that the present invention be more clearly understood, a detailed description will now be given of an exemplary embodiment of the apparatus of the present invention for performing the process of the present invention, reference being had to the accompanying drawings, in which.

DETAILED DESCRIPTION OF THE PREFERRED EMBODIMENT

Figure 1:
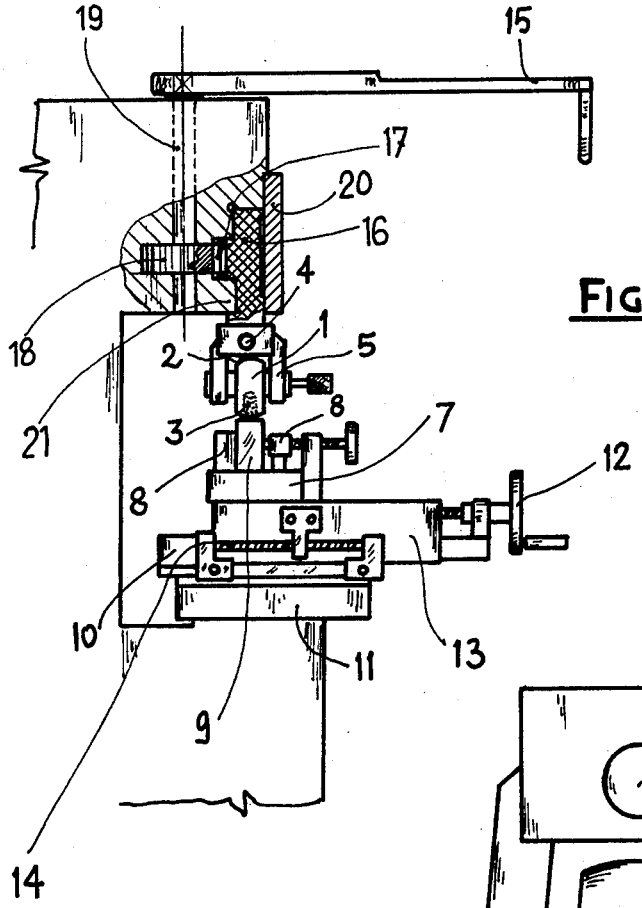
FIG. 1 is a side elevation assembly view showing the apparatus of the present invention disposed upon a suitable supporting frame, and under operative conditions.

Referring now to the drawings, it will be seen that the apparatus of the present invention, for accomplishing the process of the present invention, comprises an engraving roller 1 which is provided with a circular peripheral surface, within its peripheral plane, having a domed or arcuate configuration, and the design or pattern 3 to be engraved is formed upon surface 2 in a relief type manner.

Roller 1 is pivotably mounted, by means of a pin 4, upon a rocking form 5 which can slowly rotate about its horizontal axis. Below roller 1 there is disposed a clamping device 7 which is provided with jaws 8 between which a workpiece 9 is inserted. The clamping device 7 is provided with means for accomplishing a first to and fro translational reciprocating working or operative movement in a direction perpendicular to the axis of roller 1, such means comprising a slide mechanism 10 disposed upon a bearing platform 11.

Should the workpiece 9 have a non-planar surface, such as, for example, an arcuate surface portion, then the operative movement would comprise a movement of rotation or oscillation within a vertical plane, in lieu of a translational movement within a horizontal plane.

The second operative movement of device 7 comprises a transverse or second translational movement as determined by means of the manual rotation of a handwheel 12 rotatably mounted upon a support table 13, the latter of which is disposed within guideways 14. The second translational movement of device 7 occurs in a direction which is perpendicular to that of the first translational movement.

Positional adjustment of the roller assembly in the first direction can also be accomplished by means of the mechanism shown in FIG. 1. As seen, the roller assembly is fixed to a support block 16 having a rack 17 integrally formed therewith. The block and rack are movable along the first direction between guides 20 and 21 by means of a pinion gear 18. The gear 18 is fixedly secured to a shaft 19 which, in turn, is fixedly secured to a manually operable lever 15. Consequently, upon rotary movement of lever 15 within a horizontal plane, rotary movement of pinion 18 causes translational movement of block 16 and roller assembly 1. It is also to be noted that in lieu of manual devices 15 and 12, automatic devices and their controls, not shown, can be utilized.

Figure 2:
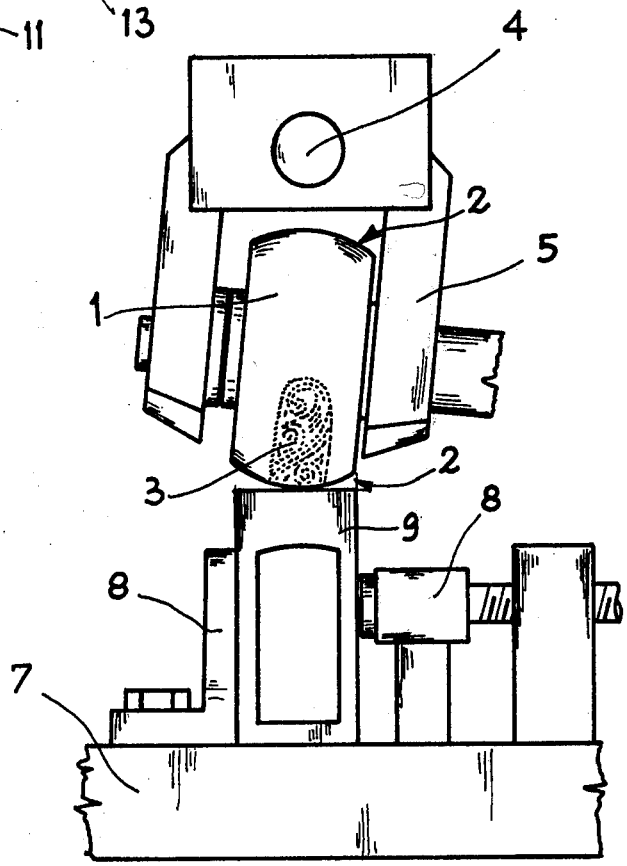
FIG. 2 is an enlarged detailed view showing the engraving roller operatively engaged with a workpiece surface.

Assuming now that an engraving process is to be performed, a workpiece 9 is interposed between jaws 8 and in contact with engraving roller 1. It is noted that roller 1 is disposed in an inclined manner with respect to workpiece 9, as best seen in FIG. 2, so that only a limited portion of the relieved design or pattern 3, to be engraved onto workpiece 9, is contacting the surface of workpiece 9, the domed shape of surface 2 facilitating this operation. Roller 1 is lightly pressed against the surface of workpiece 9 and a first forward reciprocating motion is imparted to slide mechanism 10.

Due to the pressure developed between roller 1 and the surface of workpiece 9, roller 1 is rotatably driven as a result of the translation of slider 10, and the engravings 3 are partially reproduced upon the surface of workpiece 9. If required, additional passes of slide mechanism 10 beneath roller 1 could be provided, care being taken to maintain unaltered the transverse position of support 13 and that of workpiece 9 relative to roller 1.

Subsequently, by rotating handwheel 12, or otherwise activating a similar automatic control device, a transverse displacement of support 13 is accomplished. In this manner the pressure developed between roller 1 and the surface of workpiece 9 causes fork 5 to similarly rotate or pivot, so that with its domed peripheral surface 2, roller 1 will present another portion or section of the pattern 3 to workpiece 9 so as to engrave such pattern portion upon the surface of workpiece 9.

By means of the two aforenoted translational movements, namely a to and fro reciprocating motion, and a transverse motion, the entire desired pattern can be engraved upon workpiece 9 without resorting to high operative pressure techniques, whereby a perfect, regular and uniform engraving can be obtained.

Similarly, engravings could also be provided upon dome shaped workpieces and in this case, a third movement can be provided for clamping device 7 so that such workpieces also rotate in conjunction with the engraving roller 1. It is to be noted that in such a case, the radius of curvature of the surface of the domed roller will preferably be the same as the radius of curvature of the surface of the workpiece, whereby the two surfaces are conjugated, as far as possible, to maintain a constant or uniform pressure upon all of the engraving areas.

From the foregoing, and as shown, it will be apparent to those skilled in the art that the apparatus and process of the present invention substantially improve the quality of the engravings without having to resort to high pressure techniques, as a result of the device of the present invention comprising substantially simplified and economical apparatus.

It should also be apparent that although the process has preferably been directed toward engraving of metal arms parts, the apparatus structure, and the versatility thereof, would also facilitate its use in other industrial fields.

Obviously, many modifications and variations of the present invention are possible in light of the foregoing teachings. It is therefore to be understood that within the scope of the appended claims, the present invention may be practiced otherwise than as specifically described herein.

I claim:

1. Apparatus for engraving metal elements, comprising:

an engraving roller having a predetermined pattern formed upon the peripheral surface thereof and being rotatable about a first axis;

means mounting said roller for permitting said roller to pivot about a second axis;

a workpiece disposed in contact with said peripheral surface of said engraving roller; and means mounting said workpiece for movement in planes parallel to said first and second axes such that fractional portions of said predetermined pattern are sequentially reproduced upon said workpiece.

2. Apparatus for engraving metal elements, comprising:

an engraving roller having a predetermined pattern formed upon the peripheral surface thereof and being rotatable about a first axis;

means mounting said roller for permitting said roller to pivot about a second axis;

a workpiece disposed in contact with said peripheral surface of said engraving roller;

said peripheral surface of said roller having an arcuate configuration as viewed transversely with respect to the peripheral plane of said roller such that said workpiece is in contact with only a predetermined portion of said pattern; and means mounting said workpiece for movement in a first plane parallel to said first axis, so as to cause said roller to pivot about said second axis as dictated by said arcuately configured peripheral surface of said roller, and in a second plane parallel to said second axis, such that fractional portions of said predetermined pattern are sequentially reproduced upon said workpiece.

3. Apparatus for engraving metal elements, comprising:

an engraving roller having a predetermined pattern formed upon the peripheral surface thereof and being rotatable about a first axis;

means mounting said roller for permitting said roller to pivot about a second axis;

a workpiece disposed in contact with said peripheral surface of said engraving roller; and means mounting said workpiece for movement in two mutually orthogonal planes parallel to said axes such that movement in a first one of said two planes causes a predetermined portion of said pattern to be reproduced upon said workpiece while movement in the other one of said two planes causes a different predetermined portion of said pattern to be aligned with a different portion of said workpiece for reproduction thereon.

4. The apparatus as set forth in claim 3, wherein:

said first movement is in a direction perpendicular to the axis of said engraving roller so as to cause said roller to rotate about said first axis; and said second movement is in a direction perpendicular to said second axis so as to cause said roller to pivot about said second axis.

5. The apparatus as set forth in claim 3, wherein:

said means mounting said engraving roller comprises a fork-type yoke.

6. The apparatus as set forth in claim 3, wherein:

the peripheral surface of said engraving roller has an arcuate configuration as viewed transversely with respect to the peripheral plane of said roller.

7. The apparatus as set forth in claim 3, wherein:

said means mounting said workpiece is manually controllable.

8. The apparatus as set forth in claim 3, wherein:

said means mounting said workpiece comprises a slide mechanism for performing said first movement, and a support table for performing said second movement.

9. The apparatus as set forth in claim 8, further comprising:

handwheel means for actuating said support table.

10. A process for engraving metal elements, comprising the steps of:

disposing an engraving roller, having a predetermined pattern formed upon the peripheral surface thereof and being rotatable and pivotable about first and second axes respectively, in contact with a workpiece; and moving said workpiece in planes parallel to said first and second axes such that fractional portions of said predetermined pattern are sequentially reproduced upon said workpiece.

11. A process for engraving metal elements, comprising the steps of:

disposing an engraving roller, having a predetermined pattern formed upon the peripheral surface thereof and being rotatable and pivotable about first and second axes respectively, in contact with a workpiece; and moving said workpiece in a plane parallel to said second axis such that a predetermined portion of said roller pattern is reproduced upon said workpiece, subsequently moving said workpiece in a plane parallel to said first axis such that a different predetermined portion of said roller pattern is aligned with a different portion of said workpiece, and thereafter again moving said workpiece in a plane parallel to said second axis such that said different predetermined portion of said roller pattern is reproduced upon said different portion of said workpiece.

12. The process as set forth in claim 11, wherein:

said relative movements may be continuously accomplished until the entire pattern of said engraving roller is reproduced upon said workpiece.

13. The process as set forth in claim 11, wherein:

particular relative movements of said roller and workpiece may be repeated a predetermined number of times prior to the alignment of a different portion of said roller pattern with a different portion of said workpiece so as to enhance the engraving characteristics of a predetermined portion of said roller pattern.

14. The process as set forth in claim 11, wherein:

the contact pressure developed between said engraving roller and said workpiece has a substantially low, constant value.

15. The process as set forth in claim 11, wherein:

said reproduction movements are disposed in a direction perpendicular to the axis of said engraving roller, and said alignment movements are disposed in a direction substantially parallel to the axis of said engraving roller.

* * * * *